United States Patent [19]

Scarberry et al.

[11] Patent Number: 5,007,744

[45] Date of Patent: Apr. 16, 1991

[54] STRIPS OF INTERCONNECTED PRE-OPENED RECLOSABLE BAGS

[75] Inventors: Paul W. Scarberry, Menomonee Falls; Rodney L. Kazemba, Hartland; Ralph A. Hestekin, West Bend, all of Wis.

[73] Assignee: Sharp Packaging, Inc., Sussex, Wis.

[21] Appl. No.: 454,330

[22] Filed: Dec. 21, 1989

[51] Int. Cl.[5] ..... B65D 30/32; B65D 33/16

[52] U.S. Cl. ..... 383/37; 53/451; 383/61; 383/66; 493/194

[58] Field of Search ..... 383/37, 66, 61; 206/632; 53/451; 493/194

[56] References Cited

U.S. PATENT DOCUMENTS

| | | | |
|---|---|---|---|
| 3,079,066 | 2/1963 | Roop | 206/632 |
| 3,151,803 | 10/1964 | Kaminski | 383/66 |
| 3,182,430 | 5/1965 | Hoeppner | 493/194 |
| 3,254,828 | 6/1966 | Lerner | 383/37 |
| 3,256,941 | 6/1966 | Rivman | 206/632 |
| 3,469,769 | 9/1969 | Guenther | 383/37 |
| 3,548,723 | 12/1970 | Sengewald | 493/194 |
| 4,401,213 | 8/1983 | Lerner | 383/37 |
| 4,550,831 | 11/1985 | Whitford | 383/66 |
| 4,709,399 | 11/1987 | Sanders | 383/66 |
| 4,863,285 | 9/1989 | Claxton | 383/37 |

*Primary Examiner*—Stephen P. Garbe

*Attorney, Agent, or Firm*—Quarles & Brady

[57] ABSTRACT

Strips (1,21,31,41,51) of pre-opened bags (2,2') detachably connected together in which each bag (2,2') includes a reclosable system comprising an adhesive tape (15) that is adhered along the exterior of one wall (3) of the bag (2,2') spanning an open zone (14,42) defined therein and that is adhered to an inner surface of the second wall (4) of the bag within the open zone (14,42). Methods for manufacturing strips of pre-opened reclosable bags of the foregoing type are also disclosed.

8 Claims, 5 Drawing Sheets

STEP(5)
STEP(4)
STEP(3)
STEP (2)
STEP (1)
19'
15
42
10
11
10a
36
37
38
35
6
3
4
7
5

STRIPS OF INTERCONNECTED PRE-OPENED RECLOSABLE BAGS

FIELD OF THE INVENTION

The present invention relates generally to the flexible packaging art; more specifically, the invention relates to the art of pre-opened bags connected together in the form of strips that are adapted to be filled, sealed and separated into individual filled bags, generally with automatic packaging machinery.

BACKGROUND OF THE INVENTION

Continuous strips or assemblies of pre-opened bags connected together are well known in the packaging art and provide the end user with an alternative to stacks of individual bags. The continuous strip assemblies are attractive for many packaging operations since they can be fed through various types of automatic packaging machines for filling and final sealing while in strip form and thereafter separated into individual filled bags. The continuous strips of bags are generally flattened tube-like assemblies having two layers of flexible packaging material appropriately sealed or joined together to define individual bags in the assembly that have front and rear walls, closed sides, a closed end and an open end through which the bags can be filled. The open end is sealed to form an enclosure for the packaged articles or product after filling. Individual bags are separated from the strips after being filled and sealed or concurrently with the filling and final sealing operation. The strips are made of heat sealable flexible packaging material, such as plastic films, sealable foil laminates and/or sealable paper packaging materials.

Two general constructions of pre-opened bags connected together in strips or assemblies are known in the art. One construction consists of a strip of pre-opened bags in which the open end extends transversely of the strip through one wall of each bag. This type of construction is described in U.S. Pat. No. 3,254,828, issued on June 7, 1966 to H. Lerner, now expired. The second type of construction consists of interconnected bags that have an open end extending longitudinally of the strip. An assembly of this type is described in U.S. Pat. No. 3,791,573, issued on Feb. 12, 1974 to Titchenal et al. The strips of connected bags can be supplied to the end user in roll-form or in a fan-folded stack and can be unprinted or printed in one or more colors as desired by the end user. A strip can have any selected number of bags, such as on the order of several hundred to several thousand bags per strip, and the bags can be of any specific size required by the end user.

Heat sealing techniques, which are well known in the flexible packaging art, are used to form the strips described in the patents listed above. Heat sealing is also used to close a bag after it has been filled with the selected product or articles. This results in a sealed bag that can be opened only by rupturing a portion of the bag, such as by tearing or cutting, when the ultimate consumer seeks to remove the packaged articles from the bag. This not only destroys the integrity of the bag, but in many instances results in the bag being unusable if only part of the packaged contents is to be removed when first opened.

Our present invention was developed to provide continuous strips of pre-opened bags of the foregoing type that can be reclosed after being first opened, thereby providing a bag that functions as a packaging enclosure for the articles or product remaining in the bag after some have been removed. Another objective of our invention is to provide strips of pre-opened reclosable bags that can be made with the bag making machinery commercially available from a number of companies, both in the U.S. and other countries, so that the constructions of the invention can be made without modifying the machines other than adding minor elements that can be easily installed on existing bag making machines. A further principal object of our invention is to provide pre-opened reclosable bags in the form of continuous strips that can be filled, sealed and separated into individual filled bags using automatic packaging machinery of the type now commonly available and in general use. Another principal objective of our invention is to develop strips of pre-opened reclosable bags in which individual filled bags separated from the strips are structurally altered when first opened to thereby provide a tamper-proof bag in that evidence of the first opening will be visually apparent. These and other objectives of the invention will become apparent from the detailed description that is presented below.

SUMMARY OF THE INVENTION

Our present invention provides continuous strips of pre-opened bags detachably connected together wherein one wall of each bag includes an open zone parallel to a marginal portion of the bag and an adhesive tape closure is adhered to the wall over the open zone so as to also adhere to the opposite wall of the bag and thereby close the bag at the margin along which the open zone is formed. The bags can be opened and closed repeatedly after being filled by means of the adhesive tape closure.

DESCRIPTION OF THE DRAWINGS

The complete and enabling description of the invention that follows is made by reference to the accompanying drawings illustrating several exemplary embodiments of the present invention, in which:

FIG. 17 is a sectional view of an alternate heat seal seam construction for the strips of bags of FIGS. 1-16.

DESCRIPTION OF PRESENTLY PREFERRED EMBODIMENTS

(a) FIGS. 1-7

Figure 1:
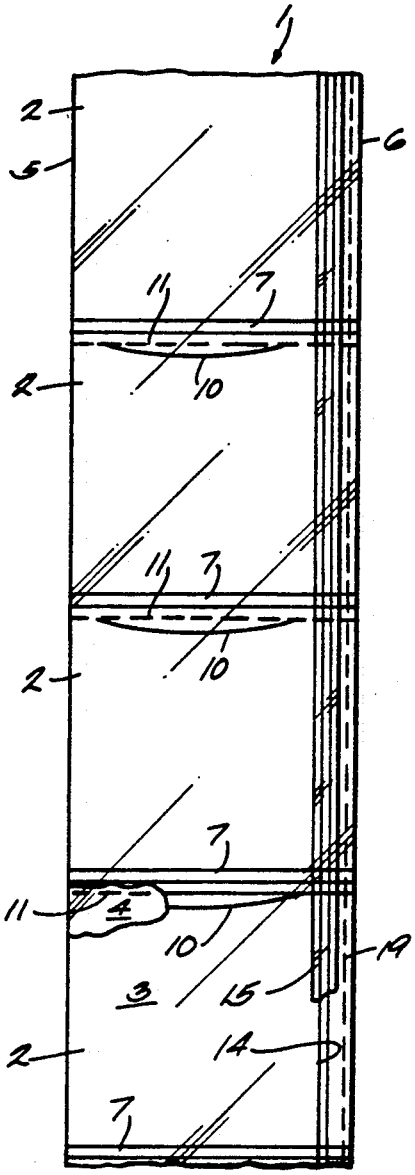
FIG. 1 is a plan view of a first continuous strip of pre-opened reclosable bags according to the invention.

FIG. 1 illustrates a portion of a strip 1 of bags 2 connected together end-to-end to form a continuous assembly having a plurality of bags detachably connected together. There can be any selected number of bags in the strip; for example, strips of 200 to 12,000 bags being useful for many commercial packaging operations.

Figure 2:
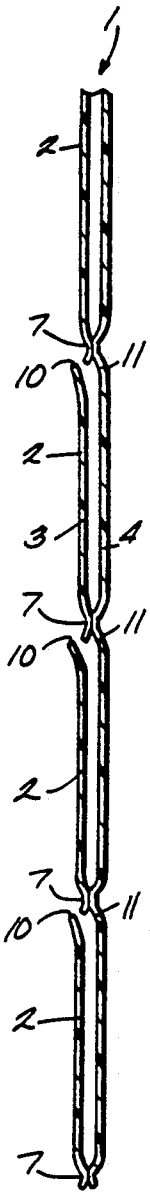
FIG. 2 is a longitudinal sectional view of the strip of FIG. 1.
Figure 3:
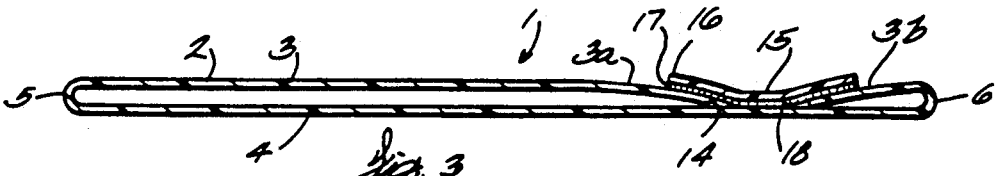
FIG. 3 is a transverse sectional view of the strip of FIG. 1.

In this first embodiment, strip 1 is formed from a tube of flexible plastic film that is flattened to define a first wall 3 and second wall 4, see especially the sectional views of FIGS. 2 and 3, that are superimposed on one another and connected together by closed longitudinal edge portions or margins 5 and 6. A series of evenly-spaced parallel transverse seals 7 extend across the strip 1 and join walls 3 and 4 together to divide the strip into units for the individual bags 2. The spacing between transverse seals 7 is selected according to the length desired for the individual bags of the strip.

Figure 4:
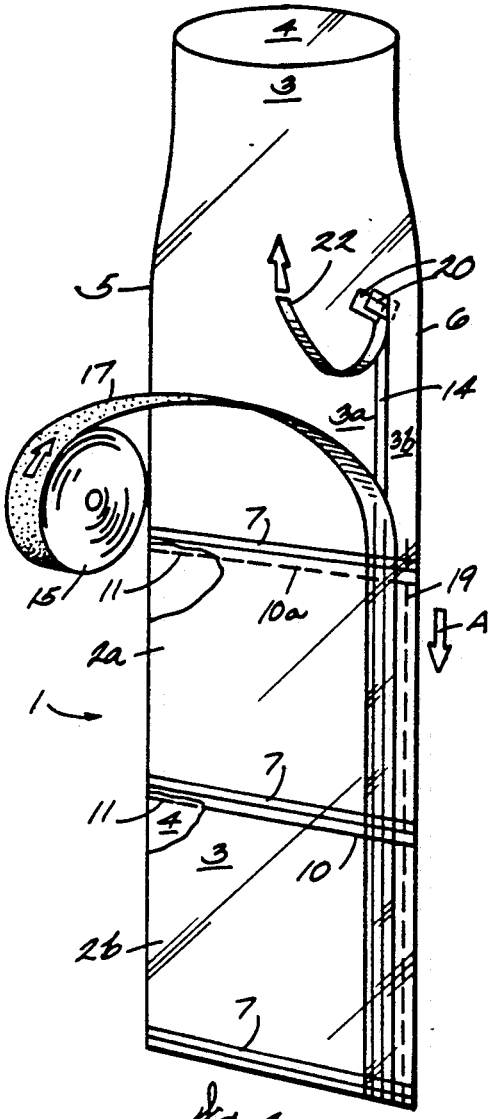
FIG. 4 is a schematic representation of a process for manufacture of the strip of bags shown in FIG. 1.

A transverse opening 10 extends across first wall 3 of the strip for each bag, there being an opening 10 close to but spaced slightly from each transverse seal 7. Also, see now the portion of one bag 2 broken away in FIG. 1 and the sectional view of FIG. 2, a transverse line of weakness 11 is formed across second wall 4 of the strip under each opening 10. Opening 10 is superimposed on line of weakness 11, and the two elements are typically formed concurrently with an appropriate mechanism of the bag making machine on which the strip 1 is formed. Openings 10 and lines of weakness 11 both can be formed as lines of spaced slits extending through each wall, lines of perforations, scored lines, or any other suitable construction along which the walls of the strip can be torn either mechanically or manually. As is most clearly visible in FIG. 2, wall 3 of the strip is separated or torn along each such line during the bag making operation so as to thereby define an opening 10 for each bag through which a bag can be filled. (Opening 10 is exaggerated by being shown curved in FIGS. 1, 2, 5, 8, 11, 13, 14 and 15 for clarity of description, but it normally remains straight and wall 3 lies flat against wall 4 of the strip such as illustrated in FIG. 4.)

The foregoing describes the structure typically found in a strip of pre-opened bags of the prior art. Each bag 2 of the strip has opposed front and rear walls defined by sections of first wall 3 and second wall 4 of the strip, opposed closed margins defined by sections of edge portions 5 and 6, a transverse closed margin defined by a transverse seal 7 and an opening in one wall of the bag defined by opening 10. Each bag remains secured to the strip by means of the lines of weakness 11 extending across wall 4 so that the strip is formed as an assembly including a plurality of pre-opened bags detachably connected together along the lines of weakness 11.

The new structural elements added to the strip 1 in accordance with the present invention will now be described, first by reference to FIGS. 1 and 3.

Turning first to FIG. 3, a longitudinal opening 14 is formed in wall 3 of the strip, which divides the wall into two longitudinal panels, panels 3*a* and 3*b*, that are separated or spaced apart from one another along the opening 14. Opening 14 thus defines an open zone in wall 3 of each bag. An adhesive tape 15 is adhered to portions of panels 3*a* and 3*b* along opposite sides of the opening and extends across the space between the two panels so as to cover opening 14. Tape 15 includes a substrate film 16 and a layer 17 of pressure sensitive adhesive on one surface of the substrate, the layer 17 being adhered to panels 3*a* and 3*b*. Further, layer 17 of tape 15 is adhered to an interior surface 18 of second wall 4 between panels 3*a* and 3*b*, i.e. within opening 14.

Referring now to FIG. 1, opening 14 formed in wall 3 extends longitudinally along strip 1 parallel to and spaced from closed edge 6 of the strip. Tape 15 also extends longitudinally along strip 1 and spaced from closed edge 6 as it spans opening 14. Further, a longitudinal line of weakness 19 is defined in both walls 3 and 4 of strip 1 between the outboard edge of tape 15 and closed edge 6 of the strip.

FIG. 4 is a schematic representation of a continuous process for manufacturing strip 1 of the foregoing construction. The strip is advanced through a bag making machine in the direction of arrow A, so that the machine direction is the longitudinal axis of the strip. Plastic film in tubular form is flattened so as to have flat walls 3 and 4 superimposed on one another and closed longitudinal edges 5 and 6. Wall 3 is lifted slightly from wall 4 and moves across a pair of spaced stationary cutting devices 20 that cut a section 22 out of wall 3 to define longitudinal opening 14. Section 22 is led to either a take-up spool or trim removal system, not shown. Cutting devices 20 are spaced apart a distance equal to the width selected for opening 14. Tape 15 is fed from a supply roll thereof and its layer 17 of adhesive is joined to panels 3*a* and 3*b* of wall 3 to cover opening 14 and also so as to adhere to the section 18 of wall 4 underlying opening 14. Longitudinal line of weakness 19 is formed after tape 15 is adhered to the strip, such as with a perforating wheel. Transverse seals 7 are then formed across the strip, such as with an appropriate heat sealing bar, to join walls 3 and 4 together. Next, superimposed lines of perforations 10*a* and 11 are simultaneously formed transversely across the strip between closed edges 5 and 6 thereof parallel to and closely adjacent each seal 7, line 10*a* being formed in wall 3 and line 11 formed in wall 4 as seen with bag 2*a* in FIG. 4. Lines of perforation 10*a* and 11 can be formed with an appropriately configured rotary knife or perforated blade knife and also can be formed simultaneously with formation of the transverse seals 7. As the last step in the process, wall 3 is separated along perforated line 10*a*, using any suitable rotating device, preferably with a high friction surface material moving slightly faster than the strip that functions to slide wall 3 relative to wall 4 and thereby separate the wall along perforated line 10*a*; separation of wall 3 along perforated line 10*a* defines opening 10 extending transversely across wall 3 as shown in connection the lowermost bag 2*b* in FIG. 1. Bag 2*b* also illustrates that perforated line 11 across wall 4 remains intact so that strip 1 consists of a chain of bags 2 connected together along wall 4. This last step results in the formation of a strip 1 of pre-opened reclosable bags of the invention that can be wound onto a core in roll form or fan folded into a carton, whichever form is preferred by the end user.

The bags 2 of strip 1 can be filled by various means, depending on the needs and equipment of the user who will package goods in the bags. The bags can be filled manually, or they can be filled with manual packaging equipment using a fan or similar device to open a bag prior to filling, or the bags can be filled with automatic packaging equipment.

Figure 5:
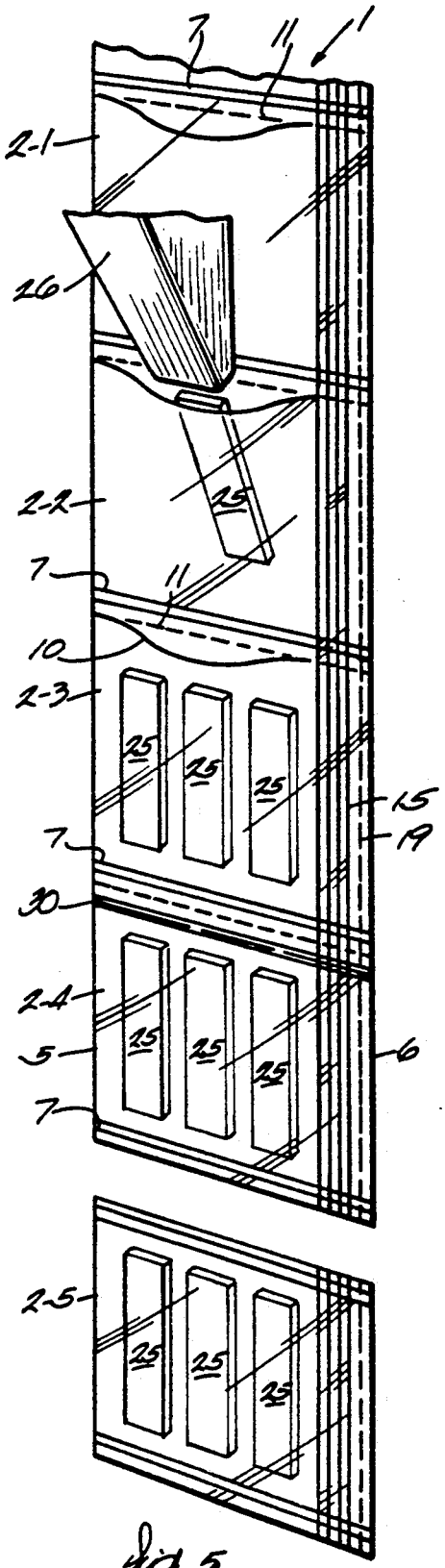
FIG. 5 schematically illustrates filling and sealing operations with the strip of bags of FIG. 1.

FIG. 5 is a schematic illustration of a process for filling and sealing bags 2 of the strip 1, such as may be carried out with an automatic packaging machine. As shown by uppermost bag 2-1 in FIG. 5, the first step involves opening the bag along opening 10, generally using a blast of compressed air. Articles 25 are then fed from a hopper 26, or other suitable dispenser for the articles or product to be packaged in the bags, into a bag through opening 10 as depicted by bag 2-2; bag 2-3 shows three articles 25 in a bag after the filling operation has been completed. Referring to bag 2-4, a transverse seal 30 is formed across the bag, such as by heat sealing, to join walls 3 and 4 together parallel to opening 10; seal 30 is formed adjacent opening 10 and line of weakness 11. Formation of the seal 30 completes the package enclosure for articles 25 as bag 2-4 is now closed along all four margins of the bag by opposed closed edges 5 and 6 along two margins and seals 7 and 30 along the other two margins. As the final step in the packaging operation with strip 1, individual filled and fully sealed bags are detached from strip 1 along each transverse line of weakness 11, as shown by bag 2-5 in FIG. 5. Separation of individual filled bags from the strip can take place after transverse seal 30 is formed or simultaneously with formation of seal 30.

Figure 6:
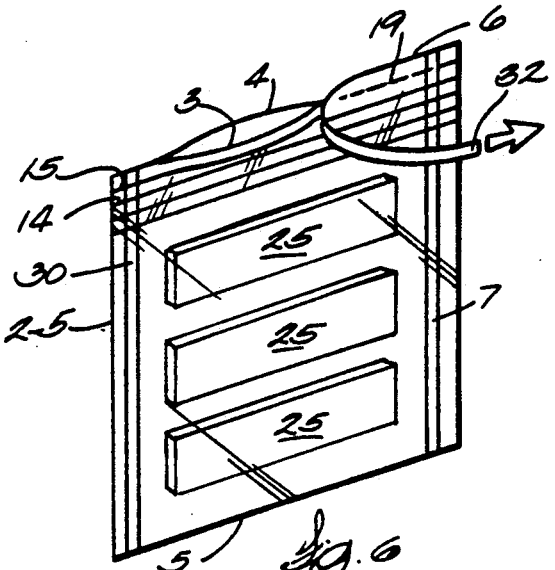
FIG. 6 is a perspective view illustrating the first opening an individual bag from the strip of FIG. 1.
Figure 7:
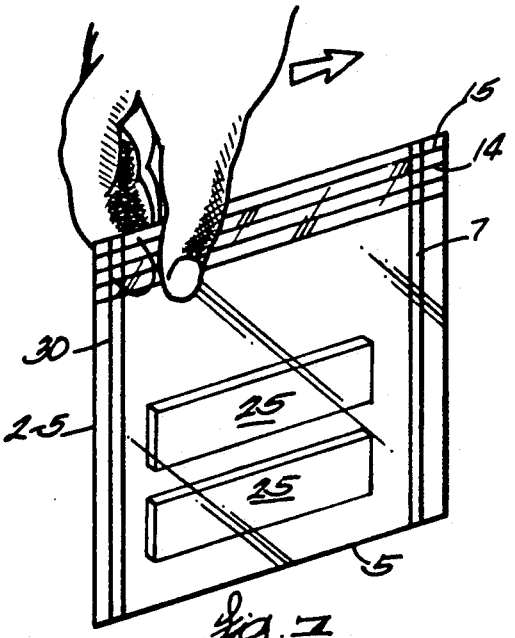
FIG. 7 is a perspective view illustrating reclosing the bag of FIG. 6 after the first and subsequent openings.

The use of a filled and sealed bag from a continuous strip of the invention by the consumer of the packaged articles or product is illustrated in FIGS. 6 and 7.

FIG. 6 illustrates bag 2-5 in the process of being opened for the first time. The consumer detaches the portion 32 of walls 3 and 4 between line of weakness 19 and closed edge 6 by tearing the two walls simultaneously along the line of weakness 19; portion 32 can then be discarded as it is not further used. After portion 32 has been removed, walls 3 and 4 are separated from one another as depicted in the drawing and the section of tape 15 adhered to wall 4 within opening 14 is peeled from wall 4 so as to thereby allow full access to the interior of the bag.

FIG. 7 shows bag 2-5 after one article 25 has been removed and the consumer is in the act of resealing the bag in order to protect the articles 25 remaining in the bag. Resealing is accomplished by pressing tape 15 against wall 4 of the bag so that its adhesive layer 17 will again become adhered to interior surface 18 of wall 4 within opening 14 of wall 3 of the bag. Resealing is thus a simple operation that can be accomplished quickly, and the bag is again fully enclosed along all four sides so as to retain the remaining articles 25 in the bag enclosure. The bag can be opened and reclosed as many times as necessary to fully use up the packaged articles.

Several other embodiments of the invention are illustrated in FIGS. 8–16 in which structural elements which are the same as corresponding elements in the first embodiment of FIGS. 1–7 are identified with the same reference numeral.

Figures 8, 9, 10, 11:
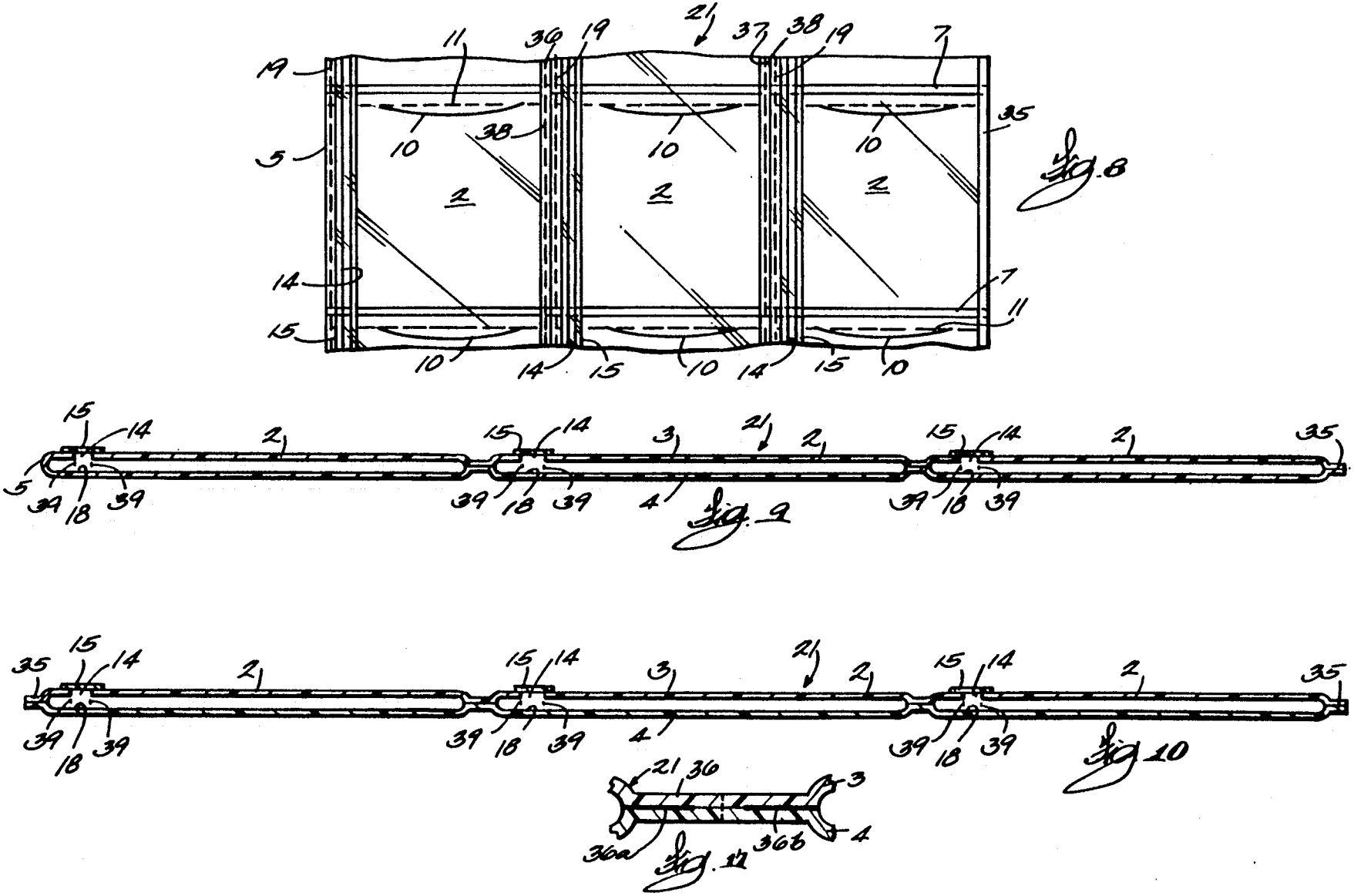
FIG. 8 is a plan view illustrating a second continuous strip of pre-opened reclosable bags according to the invention.
FIG. 9 is a transverse sectional view of the strip of bags of FIG. 8.
FIG. 10 is a transverse sectional view of another structure for the strip of bags of FIG. 8.
FIG. 11 is a plan view illustrating a third continuous strip of pre-opened reclosable bags according to the invention.
Figure 11:
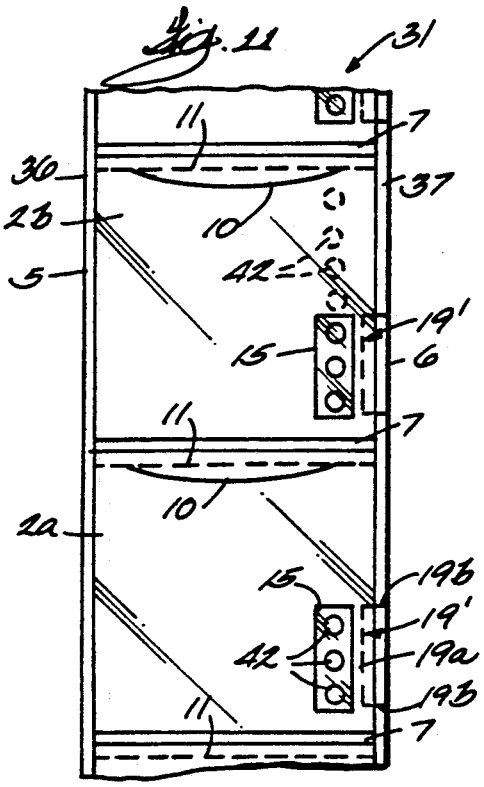

(b) FIGS. 8–10

Strips of pre-opened reclosable bags of the invention can be made with two or more bags side-by-side, one form of which is illustrated in FIGS. 8–10.

Strip 21 of FIG. 8 has three bags 2 arranged side-by-side in the strip and can be made from a flattened tube of plastic film as described above with strip 1 or a folded sheet of plastic film as shown in FIG. 9 wherein closed edge 5 is defined by a fold in the sheet and closed edge 6 is formed by a longitudinal heat seal 35 joining together the superimposed edges of walls 3 and 4. Intermediate longitudinal heat seals 36 and 37 are formed along the strip joining walls 3 and 4 and spaced apart appropriately to define three bags 2 arranged in side-by-side relationship. A longitudinal line of weakness 38 is formed along the center of seals 36 and 37.

Transverse seals 7 extend across the strip between closed edges 5 and 6, and a transverse line of weakness 11 is formed in wall 4 of the strip and also extends across the bags between closed edges 5 and 6. The strip 21 has three columns of bags 2, and an open zone 14 is formed in wall 3 of the bags in each column, with three webs of adhesive tape 15 applied to the strip, one over each open zone 14 in the manner previously described with respect to strip 1.

FIG. 10 illustrates a cross section of an alternate construction for strip 21 wherein walls 3 and 4 each comprise a separate sheet of plastic film and they are joined together by longitudinal heat seals 35 along opposite superimposed edges of the sheets to thereby define closed edges 5 and 6 of the strip.

As noted above, the strips of pre-opened reclosable bags of the invention can be made with almost any selected number of bags arranged side-by-side as exemplified by the strip 21. The number of bags arranged in this fashion is limited only by the width of film a specific bag making machine can handle and the width selected for the bags. Thus, a strip such as strip 21 is often made with from 2 to 12 bags arranged in side-by-side relationship, i.e. 2-12 columns of bags along the strip. This type of strip can be furnished to the end user who will package the bags in this multiple side-by-side relationship; however, strips of this style also can be separated into individual strips along each longitudinal line of weakness 38 after the bag manufacturing is completed.

In FIGS. 9 and 10, the webs of adhesive tape 15 are shown separated from wall 4 along each open zone 14 for clarity of description, it being understood that the adhesive layer 17 of each tape will be adhered to the interior surface 18 of wall 4 within each open zone 14 as denoted by brackets 39 in FIGS. 9 and 10, such as shown in FIG. 3.

It should be noted that all the strips of pre-opened reclosable bags of the invention described herein can be made from a flattened tubular film as described previously with respect to strip 1, a folded sheet as illustrated in FIG. 9 or two sheets of film as illustrated in FIG. 10.

Figure 12:
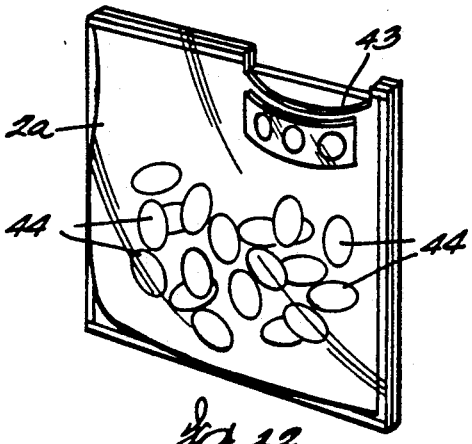
FIG. 12 is a perspective view of a filled and sealed bag from the strip of FIG. 11 in its open condition.
Figure 13:
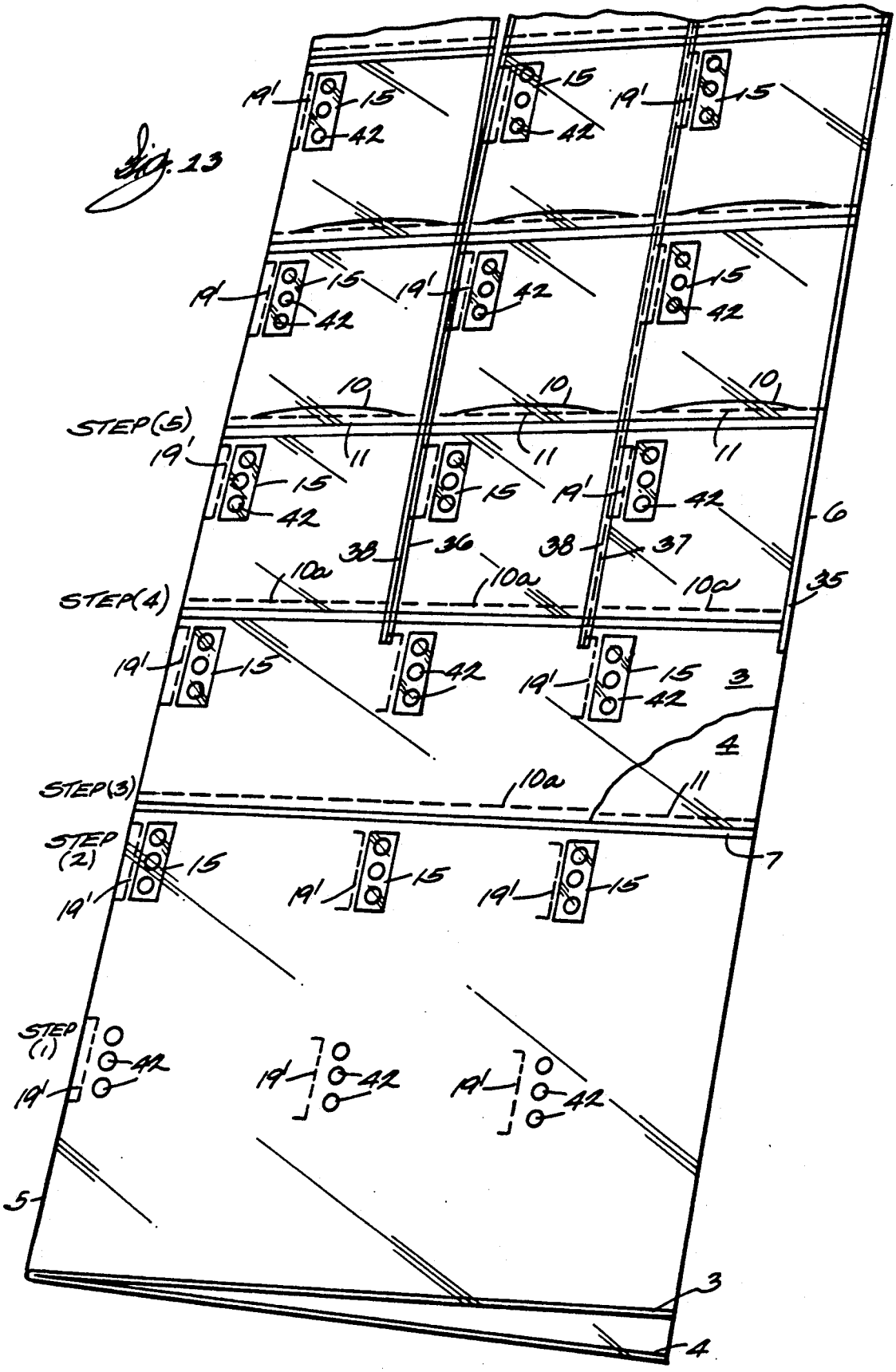
FIG. 13 is a schematic view illustrating a method for manufacture of the strip of bags of FIG. 11.

(c) FIGS. 11–13

FIG. 11 illustrates a strip 31 of pre-opened reclosable bags of the invention wherein the open zone formed along wall 3 of the bags is of a different configuration than illustrated with the previous embodiments.

Referring first to lowermost bag **2*a* of FIG. 11, the open zone in wall 3 of the bag consists of a set of three circular openings 42 arranged side-by-side in a row parallel to closed edge 6 of strip 31. A section of adhesive tape 15 covers openings 42 and is adhered to the outer surface of wall 3 of the bag outside of the openings 42 and adhered to the interior surface of wall 4 of the bag through the openings. Openings 42 are in a row spaced from and parallel to closed edge 6 of the strip. A short line of weakness 19' is defined in wall 3 of each bag alongside the openings 42 between tape 15 and closed edge 6. Each line of weakness 19' has a central portion 19*a* that is parallel and spaced from edge 6 and two cross portions 19*b*, one extending from each end of portion 19*a* to edge 6. The strip 31 thus includes a plurality of lines of weakness 19*a* longitudinally along the strip. This configuration of the open zone in wall 3 provides for a localized opening for each bag 2** along a closed margin of the bag.

FIG. 12 is a perspective view showing a filled bag 2 after it has been separated from strip 31 and has been first opend by the consumer of the articles or product packaged in the bag. The portion of walls 3 and 4 between a line of weakness 19' and closed edge 6 is removed, which results in the configuration shown in FIG. 12. When walls 3 and 4 of the bag are separated from one another and by peeling adhesive tape 15 from wall 4, a bag with a spout-like opening is formed. A bag of this type is often referred to as a "valve-bag" in the flexible packaging art. This construction provides a spout-like opening 43 near a corner of the bag through which the consumer can shake out or dispense a few of the articles or product packaged in the bag. This bag construction is particularly useful when a number of small items or parts 44, such as electronic connectors, nuts, screws, etc., are packaged in the bag or when a comminuted or granular product, such as bird seed, is packaged in the bag. After a portion of the contents of the bag are removed, opening 43 is resealed with adhesive tape 15 in the manner previously described in part (a) above.

As shown by the dashed lines of bag **2*b* in FIG. 11, the circular openings 42 also can extend in a row along an entire margin of a bag so as to define an open zone, in which case, a line of weakness 19'** will have a central portion of the same length as the open zone.

FIG. 13 is a schematic representation of the process for the manufacture of strip 31 in a multiple side-by-side arrangement of bags, starting with a folded sheet of plastic film. At step (1), the panel of the folded sheet that forms wall 3 is lifted slightly from wall 4 and three spaced rows of openings 42 are punched in wall 3 and, simultaneously, a line of weakness 19' is formed alongside each row of openings 42 such as by forming a line of perforations. At step (2), a section of adhesive tape 15 is applied over each row of openings 42. Next, at step (3), transverse seals 7 are formed across the assembly to join wall 3 to wall 4 and, simultaneously therewith, a line of perforations **10*a* is formed across wall 3 of the bag and a line of perforations 11 is formed across wall 4 of the bag, the two lines 10*a* and 11 being superimposed on one another and defined at the same time. At step (4), a longitudinal heat seal 35 is formed to join the outer edges of walls 3 and 4 together and thereby form closed edge 6 of the strip, intermediate longitudinal seals 36 and 37 are formed to join the walls 3 and 4 together to define individual columns of bags in the strip and longitudinal lines of weakness 38 are defined within seals 36 and 37 at the same time. If strip 31 is to be separated into three strips of bags, the strip is separated along a line of weakness 38 in step (4) as shown with respect to intermediate longitudinal seal 36. If strip 31 is to be delivered to a packager with several bags side-by-side, individual strips are not separated along a line of weakness 38 as shown with respect to seal 37. At step (5) first wall 3 of each bag 2 is separated along line of weakness 10*a* to thereby form an opening 10** for each bag.

Figure 14:
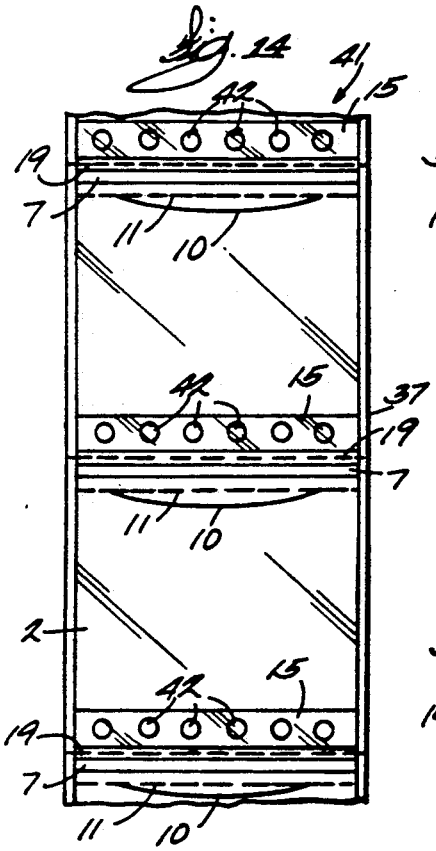
FIG. 14 is a plan view illustrating a fourth continuous strip of pre-opened reclosable bags according to the invention.

(d) FIG. 14

In the previous embodiments of the invention, the open zone defined in wall 3 of the bags of the strips has been formed parallel to a longitudinal margin of the strips of bags. However, a strip of pre-opened reclosable bags of the invention also can be made wherein the opening is formed in the transverse direction of the strip, which construction is illustrated in FIG. 14. Strip 41 of FIG. 14 comprises a plurality of bags 2 detachably connected together end-to-end as described with previous embodiments, wherein each bag 2 has a row of circular openings 42 formed transversely of the bag through wall 3 and positioned near each transverse seal 7 of the strip. A section of adhesive tape 15 is applied over each row of openings 42 such that its adhesive layer 17 will be adhered to the exterior surface of wall 3 surrounding the openings and to the interior surface of wall 4 underlying the openings. A line of weakness 19 is formed through walls 3 and 4 of the strip parallel to and closely adjacent each transverse seal 7. Strip 41 can be manufactured as described with previous embodiments.

The open zone in wall 3 of the bags is illustrated in the exemplary strips 31 and 41 as a series of circular openings 42, but spaced openings of other configurations such as squares or rectangles can be employed, and a continuous opening such as in the bags of strip 1 also can be defined in the bags of strips 31 and 41.

Figure 15:
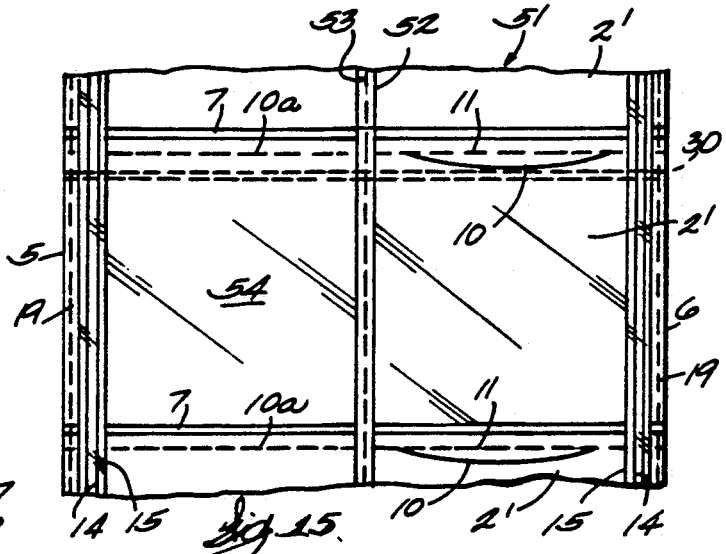
FIG. 15 is a plan view illustrating a fifth strip of pre-opened reclosable bags according to the invention.
Figure 16:
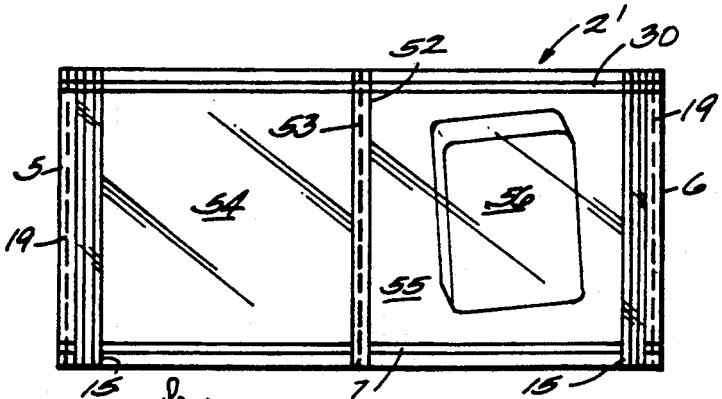
FIG. 16 is a plan view of a filled bag from the strip of FIG. 15.

(e) FIGS. 15 and 16

A strip 51 of pre-opened reclosable bags is illustrated in FIGS. 15 and 16 as still another embodiment of the present invention. The strip 51 comprises a plurality of double-compartment bags 2' detachably connected together end-to-end as described in connection with prior embodiments.

A longitudinal heat seal 52 joins walls 3 and 4 together of strip 51 and may be located centrally of each bag 2' of the strip as shown on the drawing, although other positions for seal 52 are possible. A longitudinal line of weakness 53 is defined along the center of seal 52. A longitudinal opening 14 is slightly spaced from and parallel to closed edge 6 of the strip in wall 3 and covered with an adhesive tape 15 in the manner previously described in connection with strip 1; a longitudinal line of weakness 19 extends between closed edge 6 and the outboard edge of tape 15. Similarly, an opening 14, tape 15 and line of weakness 19 are included along closed edge 5 of the strip. Strip 51 is divided into individual bags by spaced parallel transverse seals 7 that extend between closed edges 5 and 6 and join walls 3 and 4 together.

Longitudinal seal 52 divides each bag 2' into two compartments, 54 and 55. Superimposed transverse lines of weakness **10*a* and 11 extend between closed edges 5 and 6 of strip 51 parallel and closely adjacent to each transverse seal 7. However, during the bag manufacture, only the section of line of weakness 10*a* across compartment 55 of each bag is opened to form opening 10 along compartment 55** of the bags.

When the bags of strip 51 are filled with product or articles and sealed, a transverse seal 30, shown in dashed line in FIG. 15, is formed between edges 5 and 6 to join walls 3 and 4 together, seal 30 being located close to opening 10 and transverse line of weakness 11. The filled and sealed bags are then separated from strip 51 along line of weakness 11 and the section of line of weakness 10*a* across compartment 54 of the bags.

A filled and sealed bag 2' from strip 51 is illustrated in FIG. 16 with an article 56 in compartment 55 of the bag. Article 56 is of a type which is to be used and then must be disposed of; a sponge such as used in surgical procedures is an example of this type of an article, as the strip 51 can be made of sterilizable film. Article 56 is removed from compartment 55 in the manner described previously by separating walls 3 and 4 and closed edge 6 along line of weakness 19 and then peeling adhesive tape 15 from wall 4 of the bag so as to remove article 56 from compartment 55. After article 56 has been used and is ready to be discarded, compartment 54 of the bag is opened in the same manner; used article 56 is then inserted in compartment 54 and the compartment reclosed by means of adhesive tape 15 across the compartment. The two compartments can be separated from one another along longitudinal line of weakness 53 within seal 52, and compartment 54 thereby provides a fully closed enclosure for used article 56. The bags 2' can be printed with appropriate legends on compartments 54 and 55 to denote the use of their respective compartments by the end user of the packaged article.

The double-compartment bags 2' are also useful for packaging other types of products. For example, two products that are to be mixed together at the time of use can be packaged in bags 2' with one product in compartment 54 and the other in compartment 55. Hardware items that are to be combined can be packaged in the bags, with one in one compartment and the other in the second compartment. Also, the same product can be packaged in both compartments with each compartment holding a single-use portion of the product.

In the foregoing embodiments, the heat seals that include a line of weakness have been illustrated as a continuous seal from edge to edge. This is illustrated, for example, by seals 36 and 37 in FIGS. 8–10 and 13, and seal 52 in FIGS. 15 and 16. Also, however, heat seals of this type can be made with an unsealed zone along the center of the seam and the line of weakness formed in the unsealed zone. This construction is illustrated in FIG. 17, on a highly exaggerated scale for clarity of description, whereby heat seal 36 between walls 3 and 4 of strip 21 includes a left hand seal portion 36*a* and a right hand seal portion 36*b*, and walls 3 and 4 are not sealed together in the zone between portions 36*a* and 36*b*. Line of weakness 38 is formed in the unsealed zone between portions 36*a* and 36*b* of heat seal 36. The seal structure of FIG. 17 can be used for any of the strips of bags described above that incorporate a longitudinal or transverse heat seal with a line of weakness located in the heat seal.

The strips of reclosable bags described above provide a further advantageous feature in addition to the various benefits of the reclosable bag constructions. As described in connection with FIG. 6, a portion 32 of walls 3 and 4 of a bag between line of weakness 19 and closed edge 6 is removed and discarded when a bag is open. The bags of FIGS. 8–10 and FIGS. 14–16 are opened in the same manner. Similarly, the bags illustrated in FIGS. 11 and 12 are opened by removing a section of the walls 3 and 4 is along a line of weakness 19'. This kind of opening operation results in a visually detectable physical change of a closed and filled bag that provides a signal to the end user that the bag has been opened for the first time. In instances in which an unauthorized opening of a filled bag has taken place, this further provides a tamper evident construction whereby the end user will immediately know that a bag was previously opened.

There has thus been described several new constructions for strips of pre-opened detachably connected bags wherein, in accordance with this invention, each bag in the strip is provided with an open zone extending through one wall of the bag and an adhesive tape closure means over the open zone so as to cover the same and adhere to the other wall of the bag within the open zone. This results in a bag construction having a dispensing opening formed along a margin of the bag that can be opened and reclosed repeatedly by the consumer of the product or articles packaged in each bag from the strip. The bag constructions described above meet all of the objectives of the invention previously set forth, and provide both the packager and the consumer with new constructions of strips of pre-opened bags that has not heretofore been available in the packaging art. While the invention has been described by reference to several exemplary embodiments in order to fully explain its structure and manufacture to those skilled in the art, the specific constructions are examples of the invention and it is anticipated that other constructions can be devised that are within the spirit and scope of the invention and are therefore intended to be covered by the claims.

We claim:

1. In a strip having a plurality of flat pre-opened bags detachably connected together of the type including two layers of heat sealable flexible packaging material, a pair of spaced longitudinal closed edges and a plurality of spaced parallel transverse seals extending between the closed edges and joining the two layers together to define a plurality of bags therebetween, in which each bag in the strip includes (1) a first wall and a second wall consisting of sections of the two layers of the strip, (2) closed margins consisting of sections of the spaced longitudinal closed edges of the strip, (3) an open end along the first wall adjacent a transverse seal, (4) a first line of weakness along the second wall underlying the open end, and (5) a closed margin defined by a transverse seal, the improvement wherein:

each bag in the strip further includes an open zone in the first wall adjacent one closed margin of the bag, an adhesive tape closure adhered to an exterior surface of the first wall surrounding the open zone and adhered to an interior surface of the second wall within the open zone, and a second line of weakness defined in the first and second walls of the bag between the adhesive tape closure and said one closed margin of the bag, whereby a filled bag of the strip is opened by removing sections of the first and second walls along the second line of weakness and peeling the walls apart along the adhesive tape closure within the open zone and reclosed by resealing the adhesive tape closure to the second wall within the open zone.

2. A strip of bags according to claim 1, wherein:

the open zone in the first wall of each bag in the strip is defined by a continuous opening in the first wall extending parallel to said one closed margin of each bag.

3. A strip of bags according to claim 1, wherein:

the open zone in the first wall of each bag in the strip is defined by a plurality of spaced openings in the first wall.

4. A strip of bags according to claim 3, wherein:

the plurality of spaced openings extend along a portion of said one closed margin of each bag.

5. A strip of bags according to claim 1, wherein:

the strip includes a plurality of columns of bags detachably connected together in side-by-side relationship, each column including a plurality of bags.

6. A strip of bags according to any one of claims 1–5, wherein:

the adhesive tape closure includes a layer of pressure sensitive adhesive adhered to the first wall surrounding the open zone and to the second wall within the open zone.

7. In a strip of a plurality of flat pre-opened bags detachably connected together of the type including two layers of heat sealable flexible packaging material, a pair of spaced longitudinal closed edges and a plurality of spaced parallel transverse seals extending between the closed edges and joining the two layers together to define a plurality of bags therebetween, in which each bag in the strip includes (1) a first wall and a second wall consisting of sections of the two layers of the strip, (2) first and second closed margins consisting of sections of the spaced longitudinal closed edges of the strip, (3) an open end along the first wall adjacent a transverse seal, (4) a line of weakness along the second wall underlying the open end, and (5) a third closed margin defined by a transverse seal, the improvement wherein:

each bag includes a longitudinal seal joining the two layers together to divide each bag into first and second compartments;

the first compartment of each bag includes an open zone in the first wall adjacent the first closed margin of the bag, an adhesive tape closure adhered to an exterior surface of the first wall over the open zone and adhered to an interior surface of the second wall within the open zone, and a line of weakness defined in the first and second walls of the bag between the adhesive tape closure and the first closed margin of the bag; an the second compartment of each bag includes an open zone in the first wall adjacent the second closed margin of the bag, an adhesive tape closure adhered to an exterior surface of the first wall over the open zone and adhered to an interior surface of the second wall within the open zone, and a line of weakness defined in the first and second walls of the bag between the adhesive tape closure and the second closed margin of the bag;

whereby each compartment of the bags of the strip is opened by removing sections of the first and second walls along the line of weakness between the adhesive tapes and the respective first and second closed margins and peeling the walls apart along the adhesive tape closure within the open zone and reclosed by resealing the adhesive tape closure to the second wall within the zone.

8. In a method for the manufacture of a strip of flat pre-opened bags detachably connected together that includes the steps of (1) providing a flat strip of two layers of heat sealable flexible packaging material having a pair of spaced longitudinal closed edges, (2) forming a plurality of spaced parallel transverse seals extending between the closed edges and joining the two layers together to define a plurality of bags therebetween, (3) forming superimposed transverse lines of weakness in the two layers adjacent each transverse seal, and (4) separating one layer along a transverse line of weakness to form an opening through which each bag is to be filled, which method provides strips of bags each having closed margins and an opening along a wall of the bags, the improvement wherein:

the method further includes the step of (a) removing a portion of one layer of the strip to define an open zone therein adjacent a closed margin, and the step of (b) adhering a web of adhesive tape to an exterior of said one layer over the open zone and to an interior surface of the other layer within the open zone; and steps (a) and (b) are carried out prior to step (2) of the method.

* * * * *